United States Patent [19]

Bettinger

[11] Patent Number: 4,996,818

[45] Date of Patent: Mar. 5, 1991

[54] FLOOR TILE FOR A RAISED ACCESS FLOOR SYSTEM

[75] Inventor: Thomas G. Bettinger, Littleton, Colo.

[73] Assignee: Bettinger West, Inc., Denver, Colo.

[21] Appl. No.: 313,857

[22] Filed: Feb. 22, 1989

[51] Int. Cl.[5] ..... E04C 2/26; E04C 2/38

[52] U.S. Cl. ..... 52/811; 52/126.6; 52/785

[58] Field of Search ..... 52/126.6, 811, 810, 52/802, 805, 785, 126.5

[56] References Cited

U.S. PATENT DOCUMENTS

| | | | |
|---|---|---|---|
| 2,053,412 | 9/1936 | Aberson | 52/387 |
| 2,956,653 | 10/1960 | Liskey, Jr. | 52/126.6 |
| 3,222,030 | 12/1965 | Thorpe | 52/126.6 |
| 4,561,232 | 12/1985 | Gladden, Jr. et al. | 52/386 |
| 4,656,795 | 4/1987 | Albrecht et al. | 52/126.6 |

FOREIGN PATENT DOCUMENTS

| | | | |
|---|---|---|---|
| 1306680 | 9/1962 | France | 52/126.6 |

*Primary Examiner*—Michael Safavi

*Attorney, Agent, or Firm*—Charles C. Corbin

[57] ABSTRACT

Floor tile for being removably applied over the floor panels of a raised access floor system is disclosed. A tile has a generally square base portion with a generally planar major top surface and a planar major bottom surface, and features flanges that extend downwardly from each of the four edges of the base portion. A square of carpet is bonded to the top surface of the base portion. Opposing pairs of the flanges are spaced apart such that a tile may be placed over a floor panel with inner surfaces of tile flanges lying closely adjacent downwardly extending edges of the floor panel to support the tile against lateral movement upon the panel.

2 Claims, 2 Drawing Sheets

FLOOR TILE FOR A RAISED ACCESS FLOOR SYSTEM

FIELD OF THE INVENTION

This invention relates to floor tiles that may be releasably applied over the floor panels of a raised floor system.

PRIOR ART

The advancement of computer use in business and industry, with data processors, computer terminals, magnetic files and associated equipment has led to the development of so-called raised access floors, below which electrical cables, conduits and ancillary wiring may be routed so as to leave a working floor surface that is uncluttered by these items. A typical conventional raised floor assembly includes an understructure of support pedestals extending from the subfloor, and sometimes stringers extending between pedestals. A number of square, load-bearing steel panels are supported by the understructure in a regular array of rows, and form a floor that supports equipment and personnel. The panels are individually removable to allow access to the underlying conduits, etc. when required.

To provide the raised floor system with an upper surface that is quiet, shock absorbing, attractive and comfortable, it is conventional practice to adhere a tread surface material such as carpet to the top of each floor panel. While this can provide an attractive floor there is a great limitation in styles and colors of floor covering available because the carpet is normally permanently bonded to a panel. When the carpet becomes worn a problem arises because of the difficulty of removing the bonded carpet squares. Sometimes because of the labor and expense involved it is cheaper, but nevertheless expensive, to discard panel and attached carpet, and replace with new panel and carpet.

Some systems use bare-topped panels of the standard 24 inch size which are overlaid with conventional 18 inch square carpet squares equipped with releasable adhesive. This can provide unsatisfactory when there is carpet shrinkage and can require discarding of some carpet squares with access openings therein when there are relocations of work stations and equipment. One attempt at addressing the floor covering problem is found in the releasable, panel sized, floor carpets sold under the trademark TATE MODULAR carpet tile. Such tiles are relatively expensive and are of limited applicability since they can only be used on floor panel systems that are specially adapted to receive these tiles.

SUMMARY OF THE INVENTION

In view of the aforementioned prior art drawbacks and limitations it is a general object of the present invention to provide carpet tiles that may be releasably installed over the tops of the floor panels of a raised access floor system.

Another general object of the present invention is to provide a carpet tile which is universally applicable to the floor panels of raised access floor systems.

A further object is to make available a good variety of styles and colors in floor coverings for raised floor systems.

A still further object is to provide a releasable carpet tile which is securely held against lateral shifting from its centered position upon a floor panel.

Accordingly the foregoing objects and additional advantages are afforded by the present invention which provides a removable tile for covering the floor panels of a raised floor system which has floor panels arranged in a regular array, with spacing between the vertically extending side edges of adjoining floor panels. The invented tile has a square sheet-like base portion with top and bottom major surfaces, and features flanges that extend downwardly from the four edges of the base portion. A square of floor covering material, such as carpet, covers the top major surface of the base portion and is bonded thereto. The spacing between opposing pairs of flanges is such that a tile may be received over a floor panel with insides of the flanges closely fitting the vertical edges of the floor panel to hold the tile against lateral movement thereupon. In one embodiment a layer of magnetic tape material is bonded to the major bottom surface of the base portion, such that an installed tile is releasably adhered to the top of a steel floor panel. In another preferred embodiment there is an inward projection on the lower part of each flange, and the flanges are resiliently deformable such that the inward projections may snap into engagement around a lower surface of the side edges of the floor panel.

DETAILED DESCRIPTION OF THE INVENTION

Figure 1:
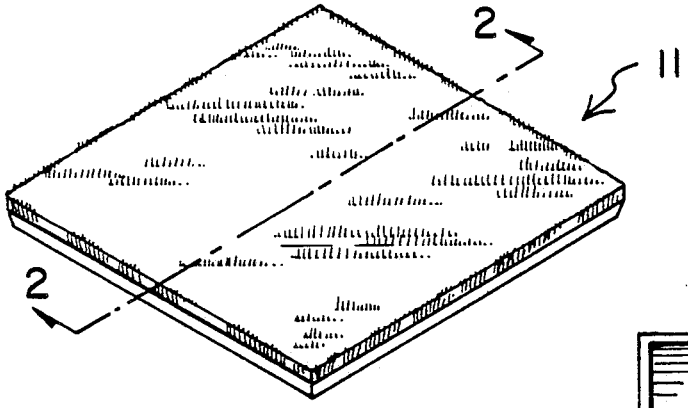
FIG. 1 is a perspective top view of a preferred embodiment of a carpet tile according to the present invention for a raised access floor system.
Figure 2:
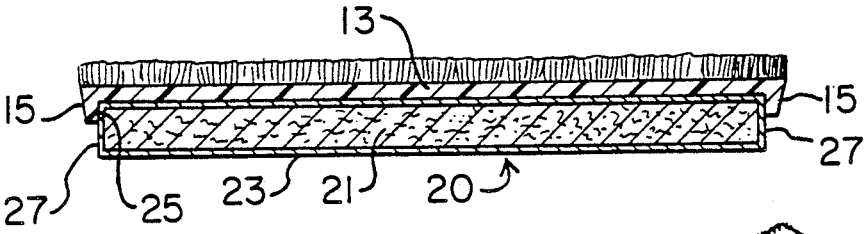
FIG. 2 is a section view of the tile of FIG. 1 taken along line 2—2 of FIG. 1, and additionally showing it applied over an elevated floor panel.

Referring now to the drawings, FIGS. 1 and 2 show one preferred embodiment of the invention to be in the form of a tile 11 that comprises a base plate 13 of a durable resilient polymeric material, having a square plan configuration, and feature, at all sides of plate 13, edge portions characterized by downwardly extending flanges or lips 15. The flat top surface of plate 13 is indicated by reference numeral 17, and a square of carpet 19 is bonded thereto by a suitable bonding agent or adhesive.

FIG. 2 illustrates application of tile 11 over a raised access floor panel 20 of one conventional design, which is square and essentially comprises a core panel of dense particle board 21 that is jacketed by a sheet steel cover 23. In a typical access floor assembly a plurality of panels 20 are supported by understructure, not shown, in a regular array with a certain spacing between all of the upright side portions 27 of adjoining panels.

The inner surfaces 25 of opposing flanges 15 are spaced apart such that they lie in close fit with the upright sides 27 of panel 20 when tile 11 is aligned over panel 20 and placed thereupon. It is by virtue of the side flanges 15 that an installed tile will be laterally supported and centered upon a floor panel. It is apparent that an installed tile 11 may be simply removed from panel 20 by raising it thereoff. It is to be understood that the disclosed tile 11 is equally applicable to floor panels of other popular designs such as the metal panel illustrated in FIGS. 5 and 7. Thus it will be appreciated that tiles according to the present invention go far towards providing tiles with universal applicability.

Figure 3:
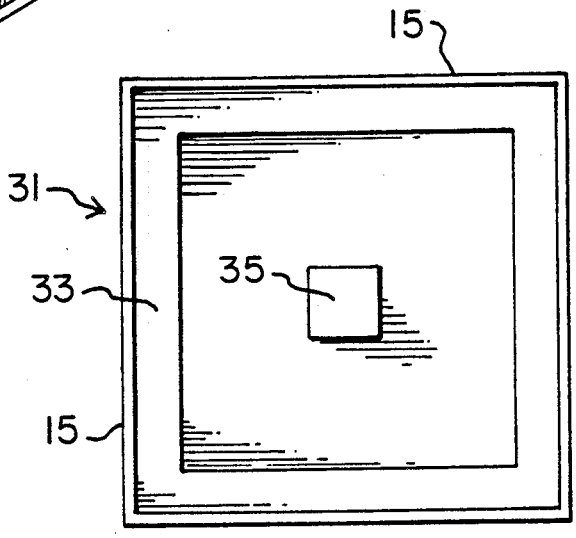
FIG. 3 is a bottom plan view of another preferred embodiment of the invention.

To enhance the vertical hold of a tile to thee metallic top of a floor panel, while remaining removable, the invention includes embodiments such as tile 31 of FIG. 3, which has a peripheral strip of conventional magnetic tape 33 bonded to its bottom. It is preferred to include a central magnetic tape piece 35 which tends to prevent any central "puffing" of an installed tile.

Figure 4:
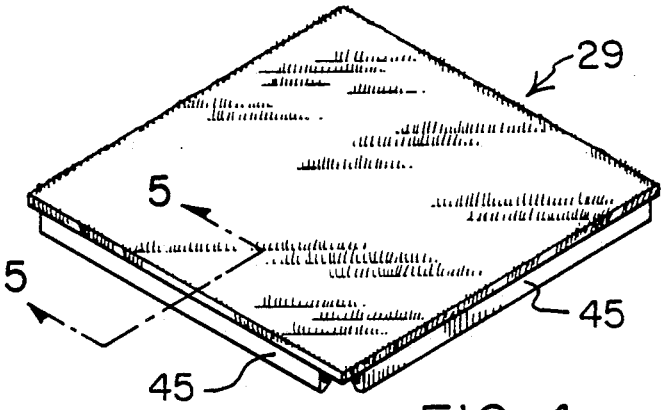
FIG. 4 is a top perspective view of still another preferred embodiment of a floor tile of the invention.
Figure 5:
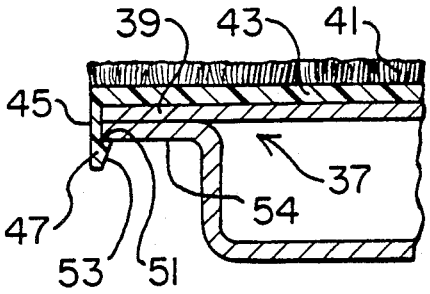
FIG. 5 is an enlarged partial sectional view of the tile of FIG. 4 taken along line 5—5, and in addition showing its application to a floor panel.

Another preferred embodiment 29 shown in FIG. 4 is particularly adapted for use with the widely used steel floor panel designs, such as the steel panel 37, partially illustrated in FIG. 5, and which typical panel structure has welded side flanges 39. FIGS. 4 and 5 show that tile 29, with bonded carpet square 41 and resilient polymeric base plate 43, features flanges 45 which have an inward projection 47. The projection 47 has an upper surface 51 and a sloped cam surface 53. The lower end of a flange 45 may be resiliently urged outwardly during installation to allow the projection 47 to pass around the outer end of a floor flange 39; after which it will return to the configuration shown in FIG. 5 with the projection's upper surface 51 in engagement with the underside 54 of flange 39. Thus tile 29 is adapted to "snap" on to a panel 37. It can be appreciated that the sloped surface 53, during one method of applying tile 29, may slidably engage the upper edge of flange 39 and urge the flange outwardly in a cam-like fashion.

Figure 6:
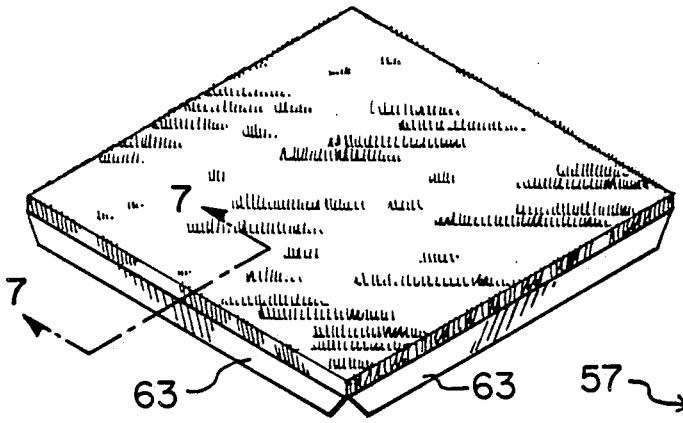
FIG. 6 is a top perspective view of another embodiment of a tile according to the invention.
Figure 7:
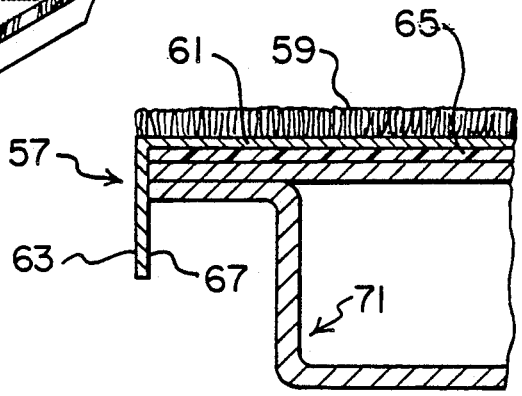
FIG. 7 is a partial sectional view taken along line 7—7 of FIG. 6 and additionally showing the tile applied over a floor panel.

Another preferred embodiment of the invention is disclosed in FIGS. 6 and 7, wherein tile 57 includes a carpet square 59 that is bonded to a baseplate 61 constructed of sheet metal and including flanges 63. A layer 65 of a polymeric material is bonded to the bottom surface of base plate 61 and is selected to have suitable shock-absorbing and sound deadening qualities.

The inner surface 67 of flanges 63 will lie snugly adjacent the outer edge of floor panel flange 69, to laterally support tile 57 on panel 71. A layer 72 of magnetic tape is bonded to the plate 61.

Figure 8:
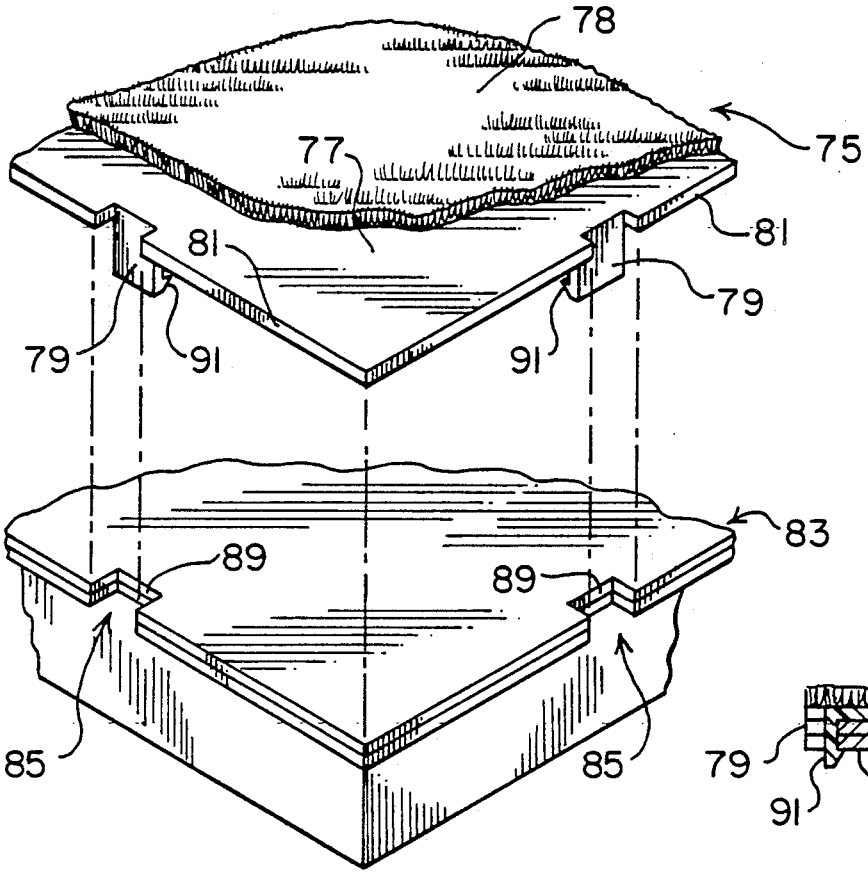
FIG. 8 is a partial top perspective view of still another variant of the invention and a floor panel adapted for use with it.
Figure 9:
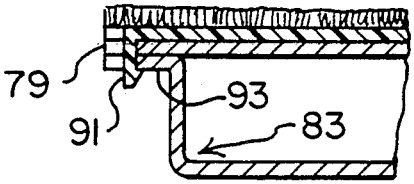
FIG. 9 is a partial sectional view showing attachment of the tile and panel of FIG. 8.

Still another variant of the invention is shown in FIGS. 8 and 9 where tie 75 comprises a polymeric base plate 77, covered with carpet 78 and featuring resilient tabs 79 which are inwardly recessed from the side edges 81 of plate 77. A modified steel floor panel 83 has recesses at 85 which are adapted to receive the tile tabs 79 to lie adjacent panel surface 89 with projecting portions 91 snapped into engagement with panel lower surface 93. There is at least one tab 79 on each of the four sides of tile 75 and the floor panel 83 is correspondingly constructed with at least one recess 85 on each of its sides. It is apparent that a tile installed as in FIG. 9 can be released by urging outwardly the lower ends of tabs 79.

Preferred embodiments have been described and is should be appreciated by those with ordinary skill in the art, that within the scope of the invention, various changes may be made. For example, design considerations in some cases within the invention may call for various configurations for the inwardly projecting portion on the flanges of the invented tile. Thus it is aimed to cover all changes as fall within the true spirit and scope of the invention.

What is claimed is:

1. Floor tile for removably covering a floor panel of a raised access floor system, which system employs a plurality of regular shaped floor panels supported in a regular array and each of said floor panels having a planar, square top and downwardly extending edges from each side of the top, said floor tile comprising:

(a) main base portion of a generally square configuration, having a major upper, and a major lower planar surface, and a flange extending downwardly from each side of said main portion; and (b) sheet of floor covering material covering the major upper planar surface of said base portion and bonded thereto, and wherein said tile is removably applicable over the top of said floor panel with said flange inside surfaces lying adjacent the downwardly extending edges of said floor panel to support said tile against lateral movement relative to said floor panel; and wherein said main base portion is comprised of metal; and including a layer of polymeric material covering and bonded to said major lower surface.

2. Floor tile for removably covering a floor panel of a raised access floor system, which system employs a plurality of regular shaped floor panels supported in a regular array and each of said floor panels having a planar, square top and downwardly extending edges from each side of the top, said floor tile comprising:

(a) main base portion of a generally square configuration, having a major upper, and a major lower planar surface, and a flange extending downwardly from each side of said main portion; and (b) sheet of floor covering material covering the major upper planar surface of said base portion and bonded thereto, and wherein said tile is removably applicable over the top of said floor panel with said flange inside surfaces lying adjacent the downwardly extending edges of said floor panel to support said tile against lateral movement relative to said floor panel; and wherein said main base portion is comprised of metal; and a layer of magnetic tape material bonded to the lower surface of said polymeric layer.

* * * * *